US006053493A

United States Patent [19]

Yokoyama et al.

[11] Patent Number: 6,053,493

[45] Date of Patent: Apr. 25, 2000

[54] SHEET FEEDER CASSETTE

[75] Inventors: Koichiro Yokoyama; Kazutoshi Kashiwabara, both of Nagano, Japan

[73] Assignee: Seiko Epson Corporation, Tokyo, Japan

[21] Appl. No.: 09/040,182

[22] Filed: Mar. 18, 1998

[30] Foreign Application Priority Data

Mar. 18, 1997 [JP] Japan ..... 9-084485

[51] Int. Cl.[7] ..... B65H 1/00; B65H 31/20

[52] U.S. Cl. ..... 271/171; 271/223; 399/393; 211/126.7

[58] Field of Search ..... 271/145, 171, 271/223; 399/393; 211/50, 126.5–126.7

[56] References Cited

U.S. PATENT DOCUMENTS

| | | | |
|---|---|---|---|
| 5,085,422 | 2/1992 | Sagara . | |
| 5,175,583 | 12/1992 | Noh et al. | 271/223 |
| 5,188,351 | 2/1993 | Gysling . | |
| 5,296,508 | 3/1994 | Hattori | 271/171 |
| 5,537,195 | 7/1996 | Sagara et al. . | |
| 5,605,323 | 2/1997 | Wirth et al. . | |
| 5,711,517 | 1/1998 | Kelly | 271/171 |

FOREIGN PATENT DOCUMENTS

| | | | |
|---|---|---|---|
| 0529803 | 3/1993 | European Pat. Off. . | |
| 6-64762 | 3/1994 | Japan | 271/145 |

*Primary Examiner*—Christopher P. Ellis
*Assistant Examiner*—Mark A. Deuble
*Attorney, Agent, or Firm*—Sughrue, Mion, Zinn, Macpeak & Seas, PLLC

[57] ABSTRACT

The telescopic structure which has a plurality of stages of sheet supporting bodies and all stages of the sheet supporting bodies are provided with top plates for covering the areas above the sheets, wherein the top plate for, at least, the last-stage sheet supporting body has of the plate member that is attached rotatably to an upper rear end part of the sheet supporting body of a stage previous to the last. The plate member can be pivoted so as to be placed on the top plate of the previous-stage sheet supporting body. The sheet feeder cassette is attached to an image forming apparatus and the top plates and such constitute the supporting body for the sheets which are discharged from the image forming apparatus.

23 Claims, 6 Drawing Sheets

SHEET FEEDER CASSETTE

BACKGROUND OF THE INVENTION

1. Field of the Invention

The present invention relates to a sheet feeder cassette for holding of sheets to be supplied to such an image forming apparatus as a printer, a plotter, a photocopier or a telecopier.

2. Description of the Related Art

A conventionally-known sheet feeder cassette has a shape of box which stores sheets to be fed. Since this type of sheet feeder cassette has a top plate, an advantage thereof is that the stored sheets are protected from dusts and such which may stick to the surfaces thereof.

Since the image forming apparatus forms images on sheets of various sizes, the sheet feeder cassettes are designed so as to store the sheets of various sizes.

For example, a sheet feeder cassette, which can store sheets of both A3 size that is comparatively large and A4 size that is comparatively small, is formed in a size that is appropriated to A3 which is the larger size and thus, when the smaller sheets of A4 size are stored, a partition plate or the similar which is provided inside the cassette is moved so as to match the A4 size or a partition plate is installed inside the cassette so that the A4-size sheets can be held.

In the sheet feeder cassette described above, since the size of the cassette itself remains in a size which is appropriated to the A3 size even when the A4-size sheets are stored, it occupies a large installation space.

Such a problem as above can be solved by a telescopic structure of the sheet feeder cassette.

However, if the sheet feeder cassette is of a telescopic structure simply with a plurality of sheet supporting bodies to constitute a plurality of stages, thickness of the sheet supporting bodies becomes smaller as the stage is closer to rear end and, as the result, another problem that the quantity of storable sheets becomes the smaller is aroused.

SUMMARY OF THE INVENTION

In view of such problems as described above, the present invention is purposed to provide a sheet feeder cassette wherein a telescopic structure can reduce the installation space thereof and wherein reduction in decrease in the quantity of storable sheets can be prevented.

According to the present invention, there is provided a sheet feeder cassette having a telescopic structure, comprising: a plurality of sheet supporting bodies being connected sequentially so as to form the telescopic structure, each of said bodies having a top plate for covering an upper surface of sheets stored in said bodies, wherein at least one of said top plates for one sheet supporting body existing in a last stage of the telescopic structure is attached to an upper side of one sheet supporting body existing in a previous stage to the last stage.

In the sheet feeder cassette, said one top plate for said one sheet supporting body existing in the last stage preferably comprises a plate member pivotally attached to an upper rear end part of said one sheet supporting body existing in the previous stage.

Further, said plate member is pivoted so as to be placed on a top plate of said one sheet supporting body existing in the previous stage.

Furthermore, when said sheet supporting bodies existing in the last and previous stages are stored in one sheet supporting body existing in a more previous stage to the previous stage, said plate member is preferably accomodated in a recess formed in a top plate for said one sheet supporting body existing in the more previous stage.

Still further, said sheet feeder cassette can be designed so as to be attached to an image forming apparatus, and said top plates support the sheet discharged from the image forming apparatus unitedly.

Since the sheet feeder cassette according to the present invention has a telescopic structure with a plurality of sheet supporting bodies to constitute a plurality of stages, an installation space thereof can be reduced by extending or compressing the cassette size so as to match various sizes of the sheets. Additionally, since all stages of the sheet supporting bodies are provided with top plates for covering the areas above the sheets, dusts and such are prevented from sticking to the surface of the stored sheets.

Moreover, since the top plate for, at least, the last-stage sheet supporting body has the plate member that is attached pivotally to the upper rear end part of the sheet supporting body of a stage previous to the last, the quantity of the sheets to be stored can be increased by the thickness of the top plate. To describe this more in detail, if a sheet feeder cassette has a telescopic structure simply with a plurality of sheet supporting bodies to constitute a plurality of stages, for instance, and if all stages of the sheet supporting bodies are provided with top plates for covering the areas above the sheets, the second-stage sheet supporting body, for example, must be stored inside the first-stage sheet supporting body and thus the thickness of the second-stage sheet-supporting body is smaller than the first-stage sheet supporting body by at least the thicknesses of the bottom plate and the top plate thereof; the thickness of the storable sheets (that is, the quantity of the sheets) is subject to the thickness of the second-stage sheet supporting body and thus, as the result, the thickness of the storable sheets (that is, the quantity of the sheets) which are spread over the first- and the second-stage sheet supporting bodies is only a remainder of the thickness of the first-stage sheet supporting body lessened by the thicknesses of the bottom plate and the top plate of the second-stage sheet supporting body.

On the contrary, in the sheet feeder cassette according to the present invention, the top plate for, at least, the last-stage sheet supporting body has the plate member that is attached pivotally to the upper rear end part of the sheet supporting body of a stage previous to the last, can increase at least the thickness of the storable sheets which are spread over the last-stage and the previous-to-the-last-stage sheet supporting bodies by as much as the thickness of the top plate.

Further, the aforenamed plate member can be pivoted so as to be placed on a top plate of the aforenamed previous-stage sheet supporting body, the plate member will not be in the way when the last-stage sheet supporting body is stored inside the previous-stage sheet supporting body.

Further, the aforenamed sheet feeder cassette is designed so as to be attached to an image forming apparatus and wherein the aforenamed top plates constitute a supporting body for sheets which are discharged from the image forming apparatus, the image forming apparatus needs not to be provided with another discharged-sheet supporter and, consequently, the image forming apparatus can be made compact.

DETAILED DESCRIPTION OF THE PREFERRED EMBODIMENTS

An embodiment of the present invention will now be described with references to drawings.

Figure 1:
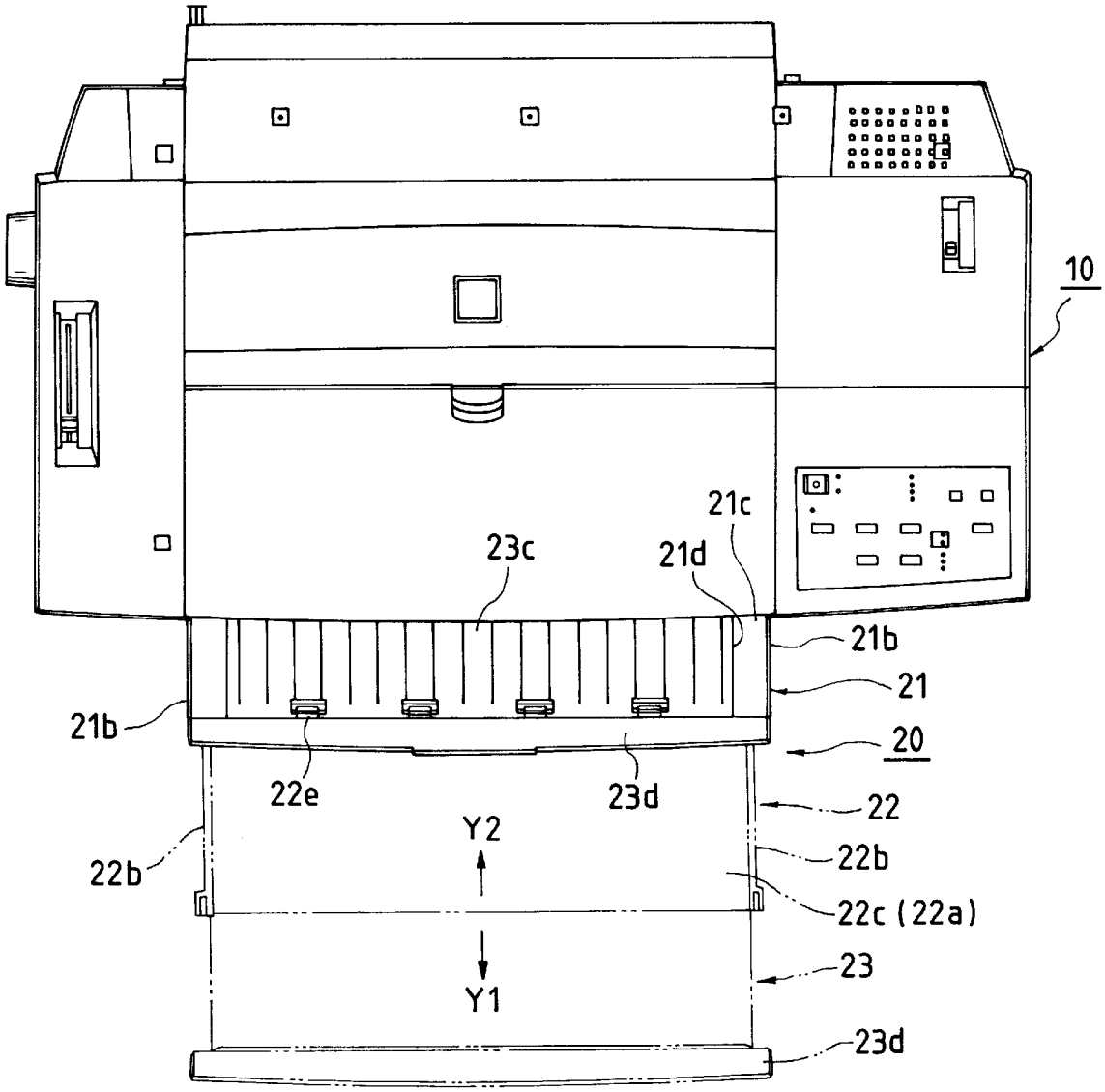
FIG. 1 is a plan of a printer as an example of the image forming apparatus with adoption of a mode of an embodiment of a sheet feeder cassette related to the present invention.
Figure 2:
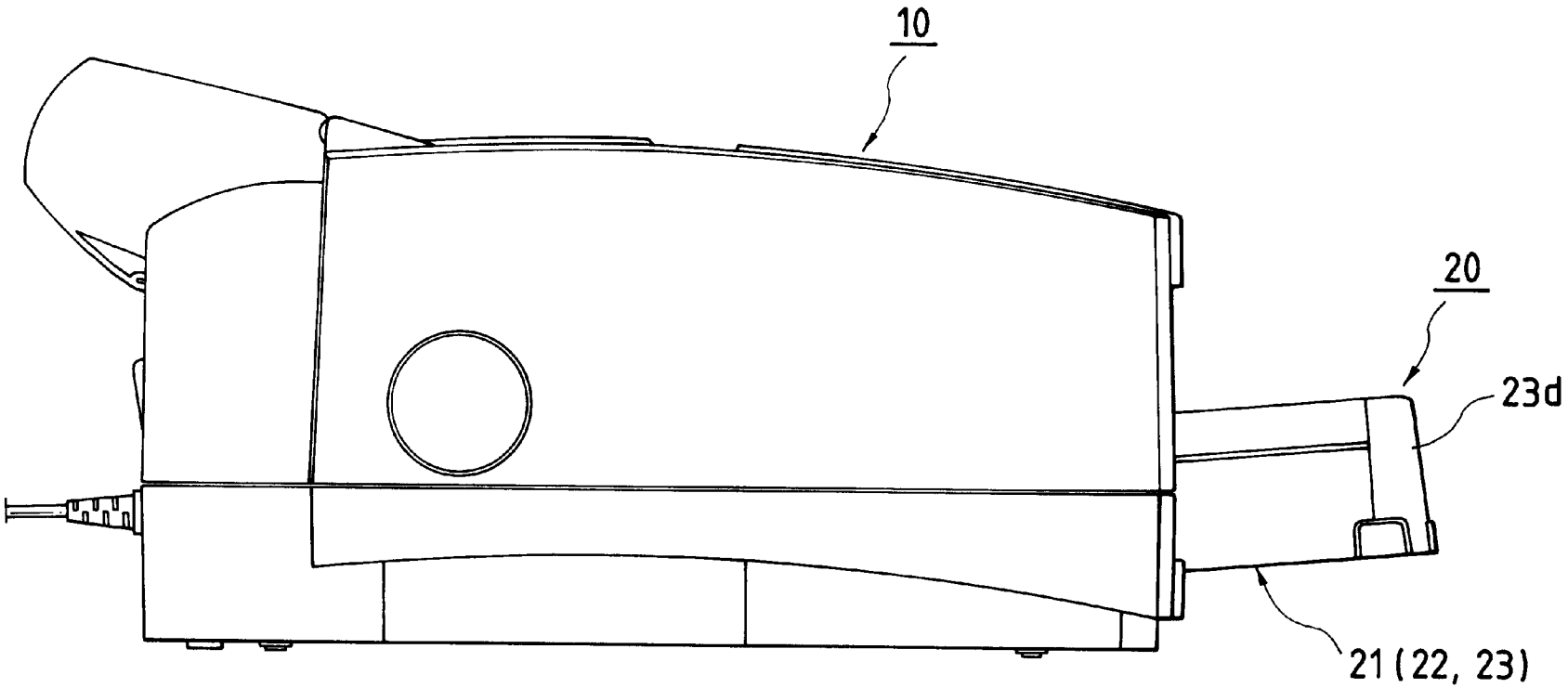
FIG. 2 is a left-side view of the same.
Figure 3:
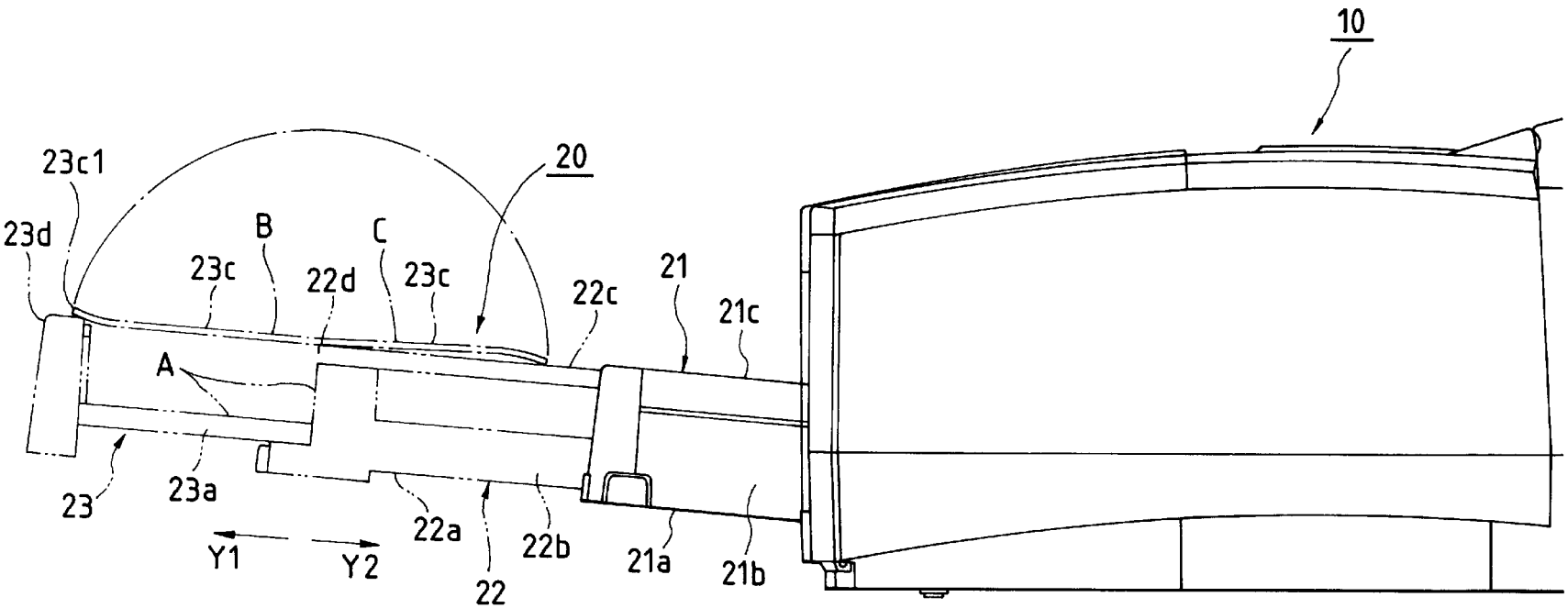
FIG. 3 is a right-side view of the same.

FIG. 1 is a plan of a printer as an example of the image forming apparatus with adoption of a mode of embodiment of a sheet feeder cassette related to the present invention, FIG. 2 is a left-side view and FIG. 3 is a right-side view.

These figures show a printer main body 10 and a sheet feeder cassette 20.

As shown in FIGS. 1 and 3, the sheet feeder cassette 20 in this mode of embodiment has a telescopic structure comprising three stages of sheet supporting bodies 21, 22 and 23.

The first-stage sheet supporting body 21 has a shape of square pipe which comprises a bottom plate 21*a*, a pair of lateral side plate 21*b* and a top plate 21*c*, and has such a structure as to be detachably attached to the printer main body 10.

Figure 4:
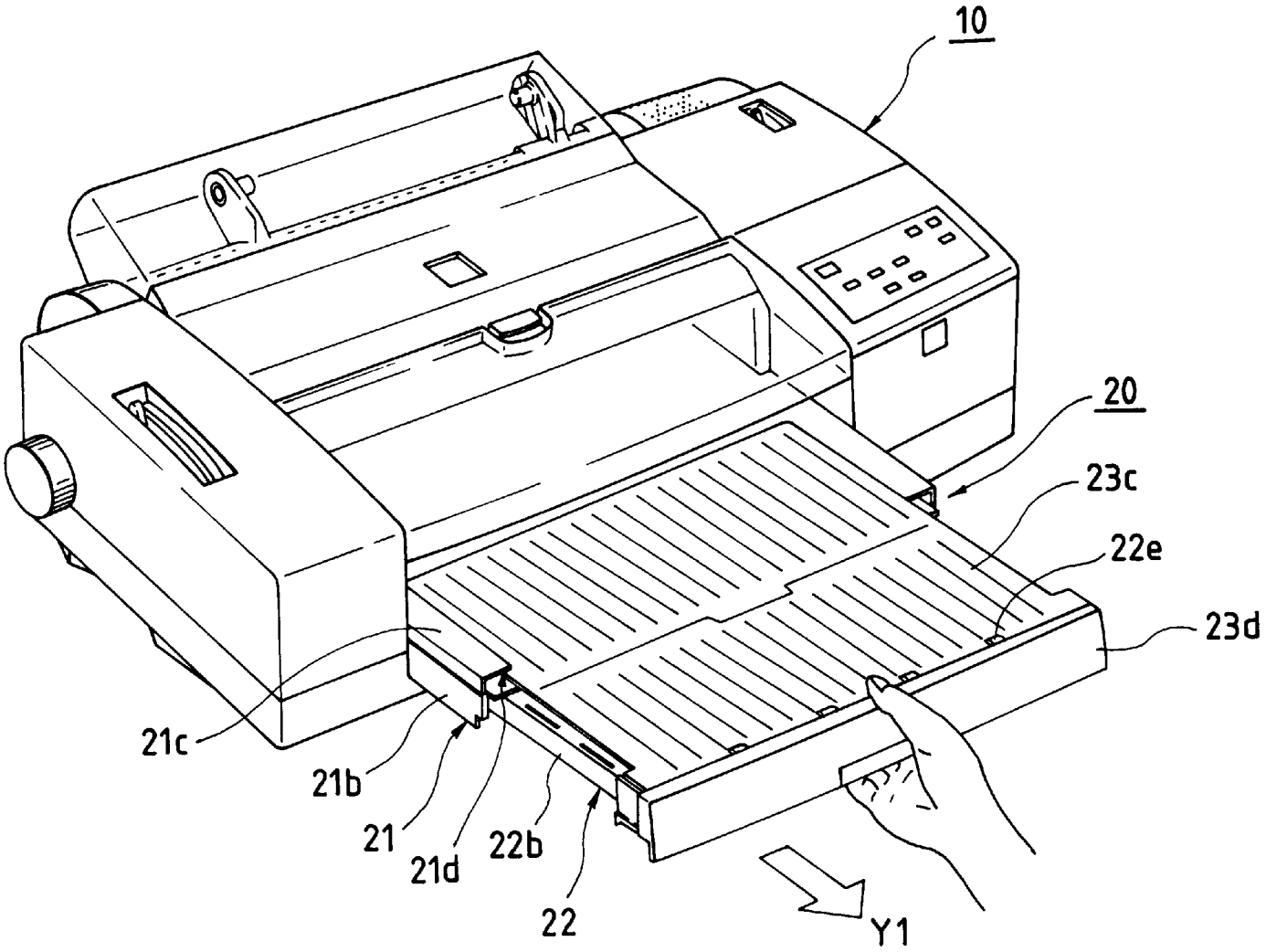
FIG. 4 is a perspective view of the printer in which a second-stage sheet supporting body of the sheet feeder cassette is drawn out from a first-stage sheet supporting body.

The second-stage sheet supporting body 22 has a shape of square pipe which comprises a bottom plate 22*a*, a pair of lateral side plate 22*b* and a top plate 22*c*, and has such a structure as to emerge from and submerge into the above-described first-stage sheet supporting body 21 in directions of arrows Y1 and Y2. FIG. 4 shows a state in that the second-stage sheet supporting body 22 is drawn out from the first-stage sheet supporting body 21. The virtual lines in FIGS. 1 and 3 show a drawn-out state.

Figure 5:
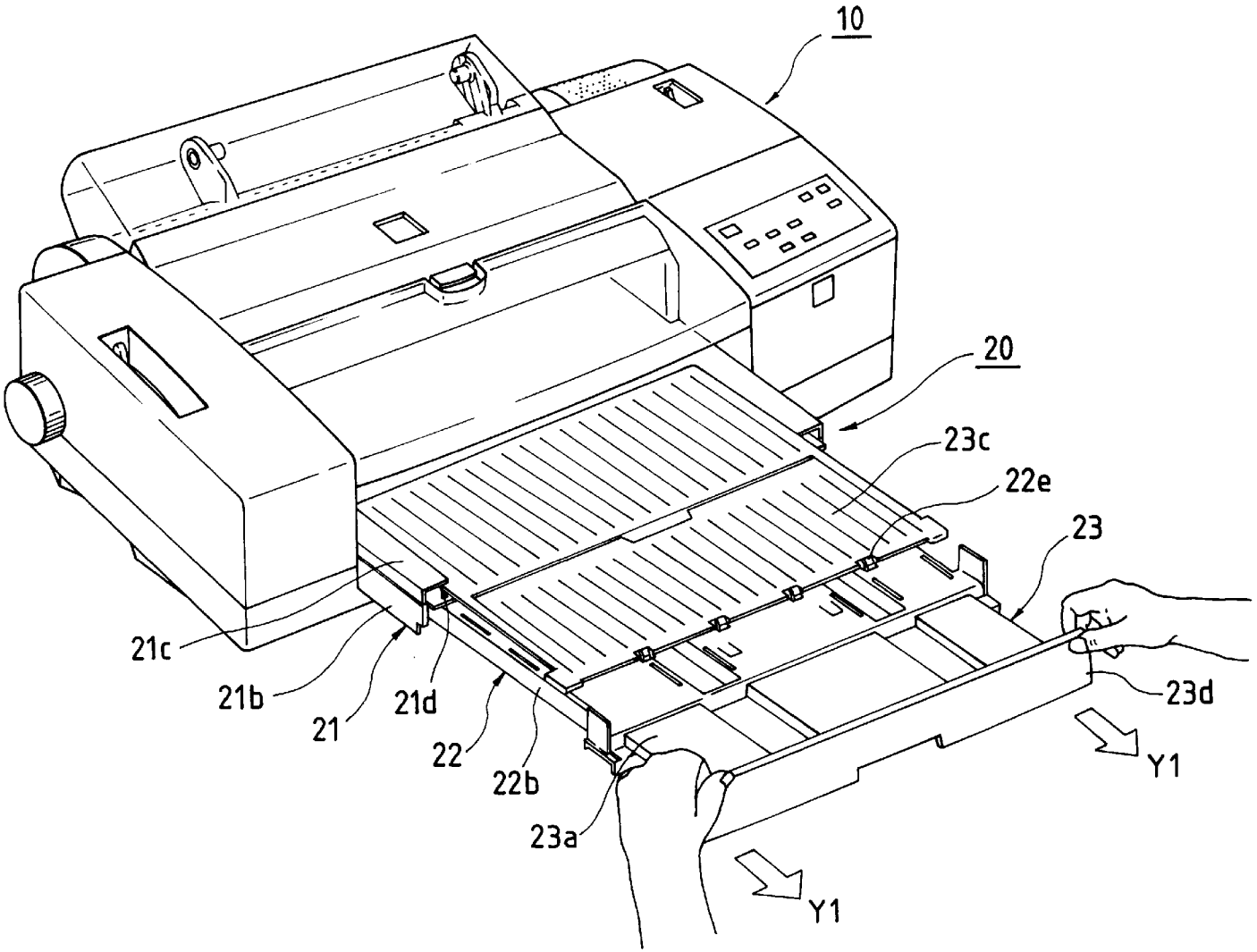
FIG. 5 is a perspective view of the printer in which a third-stage sheet supporting body of the sheet feeder cassette is drawn out from the second-stage sheet supporting body.

The third-stage sheet supporting body 23 which is the last-stage sheet supporting body of this mode of embodiment comprises a bottom plate 23*a* and a rear end wall 23*d*, and has such a structure as to emerge from and submerge into the above-described second-stage sheet supporting body 22 in directions of arrows Y1 and Y2. FIG. 5 shows a state in that the third-stage sheet supporting body 23 is drawn out from the second-stage sheet supporting body 22. The third-stage sheet supporting body 23 may be but does not have to be provided with lateral side plates. The virtual lines in FIGS. 1 and 3 show a drawn-out state.

Figure 6:
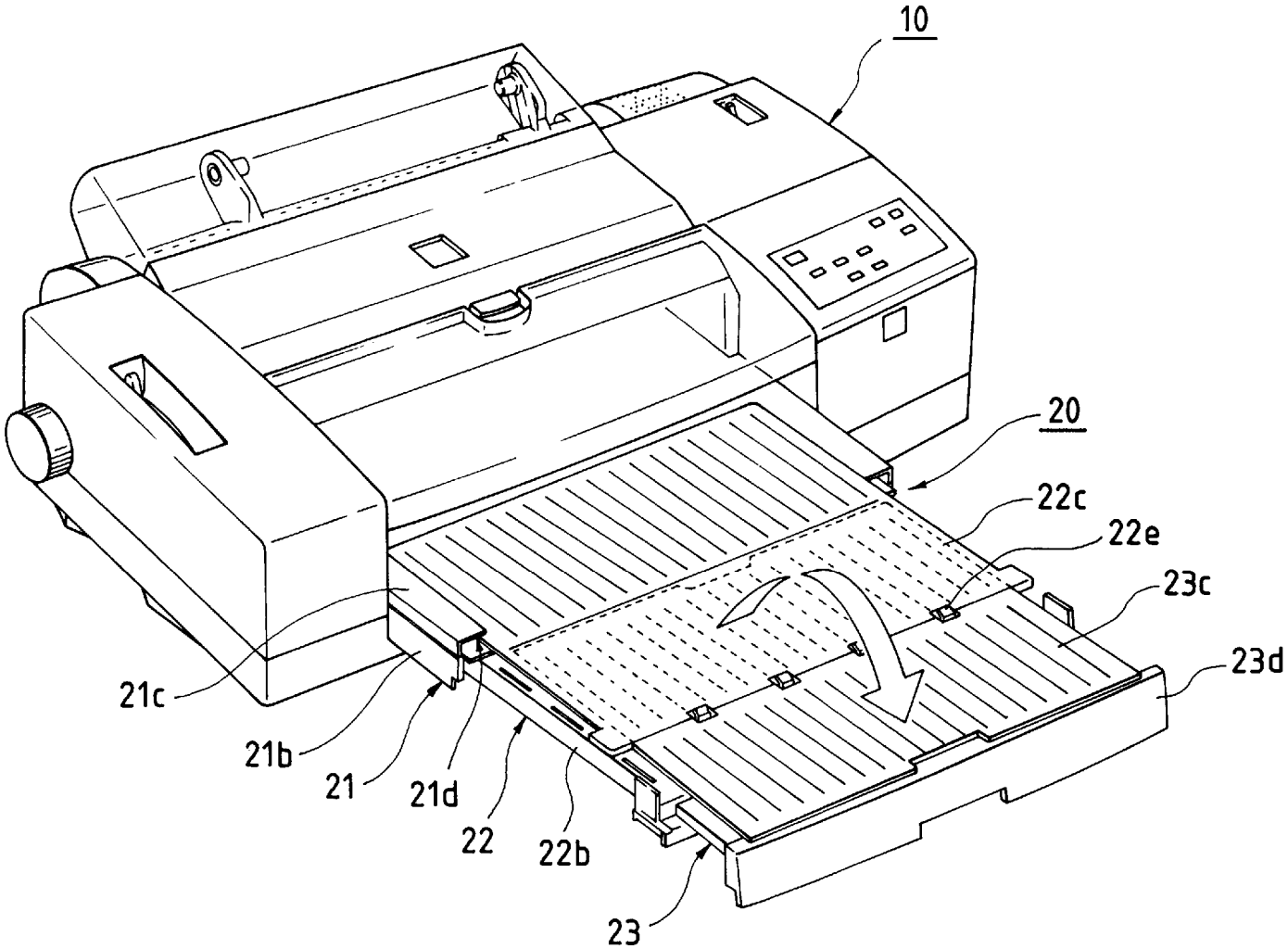
FIG. 6 is a perspective view of the printer in which a plate member is turned over onto the third-stage sheet supporting body.

A plate member 23*c* constitutes the top plate of the last-stage sheet supporting body 23. The plate member 23*c* is attached pivotally to an upper rear end part 22*d* of the previous-stage sheet supporting body which is the second-stage sheet supporting body 22 in this mode of embodiment with hinges 22*e* (see FIGS. 3 and 6). After the second- and the third-stage sheet supporting bodies 22 and 23 are drawn out as indicated in virtual lines A in FIG. 3, if the plate member 23*c* is turned over onto the third-stage sheet supporting body 23 as indicated in virtual lines B, a fore end 23*c*1 thereof comes into contact with the rear end wall 23*d* to form a top plate for the third-stage sheet supporting body 23 (FIG. 6). When the third-stage sheet supporting body 23 is stored inside the second-stage sheet supporting body 22, as indicated in virtual lines C in FIG. 3, the plate member 23*c* is placed on the top plate 22*c* for the second-stage sheet supporting body 22. Furthermore, when the second-stage sheet supporting body 22 is stored in the first-stage sheet supporting body 21, as indicated in solid lines in FIG. 1, the plate member 23*c* is accomodated in a recess 21*d* which is formed in the top plate 21*c* for the first-stage sheet supporting body 21.

Through telescopic operations of the sheet supporting bodies 21, 22 and 23, this sheet feeder cassette 20 holds sheets of various sizes, from postcard-size to longitudinally positioned A2 size. As indicated in virtual lines, longitudinally-positioned A2 size sheets can be stored in a state wherein the second- and the third-stage sheet supporting bodies are drawn out. Supporting plates are provided inside the cassette 20 for preventing stored small-sized sheets, such as A4 size, from shifting.

The printer main body 10 picks up sheets placed inside the sheet feeder cassette 20, one sheet each time and, after printing, discharges the sheets onto the sheet feeder cassette 20.

That is, the sheet feeder cassette 20 has a structure wherein the top plates 21*c*, 22*c* and 23*c* constitute a supporting part for the sheets discharged from the printer main body 10. In other words, top plates 21*c*, 22*c* and 23*c* support the discharged sheets unitedly.

The following operational effects are obtained from the sheet feeder cassette 20 as described above:

The telescopic structure which comprises three stages of sheet supporting bodies 21, 22 and 23, the installation space thereof can be reduced by extending or compressing the cassette size so as to match various sizes of the sheets. Additionally, since all stages of the sheet supporting bodies are provided with top plates for covering the areas above the sheets, dusts and such are prevented from sticking to the surface of the stored sheets.

Moreover, since the top plate for, at least, the last-stage sheet supporting body 23 has the plate member 23*c* that is attached pivotally to the upper rear end part 22*d* of the sheet supporting body 22 of a stage previous to the last, the quantity of the sheets to be stored can be increased by the thickness of the top plate 23*c*. To describe this more in detail, if the sheet feeder cassette 20 has the telescopic structure simply with a plurality of sheet supporting bodies to constitute a plurality of stages, for instance, and if all stages of the sheet supporting bodies are provided with top plates for covering the areas above the sheets, the third-stage sheet supporting body 23, for example, must be stored inside the second-stage sheet supporting body 22 and thus the thickness of the third-stage sheet-supporting body 23 is smaller than the thickness of the second-stage sheet supporting body 22 by at least the thicknesses of the bottom plate 23*a* and the top plate 23*c* thereof; the thickness of the storable sheets (that is, quantity of the sheets) is subject to the thickness of the third-stage sheet supporting body 23 and thus, as the result, the thickness of the storable sheets (that is, quantity of the sheets) which are spread over the first-stage sheet supporting body 21 through the third-stage sheet supporting body 23 is only the remainder of the thickness of the second-stage sheet supporting body 22 lessened by the thicknesses of the bottom plate 23*a* and the top plate 23*c* of the third-stage sheet supporting body 23.

On the contrary, the sheet feeder cassette in this mode of embodiment, wherein the top plate for, at least, the last-stage sheet supporting body 23 comprises the plate member 23*c* that is attached pivotally to an upper rear end part 22*d* of the sheet supporting body 22 of a stage previous to the last, can increase at least the thickness of the storable sheets which are spread over the last-stage and the previous-to-the-last-stage sheet supporting bodies by as much as the thickness of the top plate 23*c*.

Further, since the plate member 23*c* can be pivoted so as to be placed on the top plate 22*c* of the previous-stage sheet supporting body 22, the plate member 23*c* will not be in the way when the last-stage sheet supporting body 23 is stored inside the previous-stage sheet supporting body 22.

Further, since the top plates 21*c*, 22*c* and 23*c* of the sheet feeder cassette 20 constitute the supporting body for the sheets which are discharged from the printer main body 10, the printer main body 10 needs not to be provided with another discharged-sheet supporter and, consequently, the printer as a whole can be made compact.

Although the mode of one embodiment of the present invention has been described above, the present invention is not restricted to the above embodiment, but there may be many modifications, changes, and alterations without departing from the scope or spirit of the main characteristics of the present invention.

For example, although the above embodiment comprises three stages of sheet supporting bodies, two stages or four stages and more are also available.

Further, in the aforementioned embodiment, the plate member 23*c* is attached pivotally to the second-stage sheet supporting body 22. However, the plate member may be attaced slidably to the second-stage sheet supporting body.

What is claimed is:

1. A sheet feeder cassette having a telescopic structure, comprising:

a plurality of sheet supporting bodies being connected sequentially so as to form the telescopic structure, each of said bodies having a top plate for covering an upper surface of sheets stored in said bodies, wherein at least one of said top plates for one sheet supporting body existing in a last stage of the telescopic structure is attached to an upper side of said top plate of one sheet supporting body existing in a previous stage previous to the last stage, and wherein said one top plate for said one sheet supporting body existing in the last stage comprises a plate member pivotally attached to an upper rear end part of said one sheet supporting body existing in the previous stage.

2. The sheet feeder cassette according to claim 1, wherein said plate member can be pivoted so as to be placed on a top plate of said one sheet supporting body existing in the previous stage.

3. The sheet feeder cassette according to claim 2, wherein said sheet feeder cassette further comprises an attachment mechanism to attach said sheet feeder cassette to an image forming apparatus, and said top plates support the sheet discharge from the image forming apparatus unitedly.

4. The sheet feeder cassette according to claim 1, further comprising a first sheet supporting body existing in a more previous stage to the previous stage and having a first top plate with a recess formed therein wherein said sheet supporting bodies existing in the last and previous stages are stored in said first sheet supporting body and said top plate for said one sheet supporting body existing in the last stage is accommodated in said recess in said first top plate.

5. The sheet feeder cassette according to claim 4, wherein said sheet feeder cassette further comprises an attachment mechanism to attach said sheet feeder cassette to an image forming apparatus, and said top plates support the sheet discharged from the image forming apparatus unitedly.

6. The sheet feeder cassette according to claim 1, wherein said top plate for said one sheet supporting body existing in the last stage is stowed on top of said top plate for the sheet supporting body existing in the previous stage.

7. The sheet feeder cassette according to claim 6, wherein said sheet feeder cassette further comprises an attachment mechanism to attach said sheet feeder cassette to an image forming apparatus, and said top plates support the sheet discharged from the image forming apparatus unitedly.

8. The sheet feeder cassette according to claim 1, wherein said sheet feeder cassette further comprises an attachment mechanism to attach said sheet feeder cassette to an image forming apparatus, and said top plates support the sheet discharged from the image forming apparatus unitedly.

9. The sheet feeder cassette according to claim 1, wherein said top plate for the one sheet supporting body existing in said last stage covers an entire top open surface area of said last stage when said last stage is in a projected position.

10. A sheet feeder cassette having a telescopic structure, comprising:

a plurality of sheet supporting bodies being connected sequentially so as to form the telescopic structure, each of said bodies having a top plate for covering an upper surface of sheets stored in said bodies, wherein one of said top plates for one sheet supporting body existing in a last stage of the telescopic structure is attached to an upper side of said top plate of one sheet supporting body existing in a previous stage previous to the last stage, and wherein said one of said top plates for one sheet supporting body existing in the last stage is detached from the last stage when the last stage is stowed in the previous stage.

11. The sheet feeder cassette according to claim 10, further comprising a first sheet supporting body existing in a more previous stage to the previous stage and having a first top plate with a recess formed therein wherein said sheet supporting bodies existing in the last and previous stages are stored in said first sheet supporting body and said top plate for said one sheet supporting body existing in the last stage is accommodated in said recess in said first top plate.

12. The sheet feeder cassette according to claim 10, wherein said top plate for said one sheet supporting body existing in the last stage is stowed on top of said top plate for the sheet supporting body existing in the previous stage.

13. A sheet feeder cassette having a telescopic structure, comprising:

a plurality of sheet supporting bodies being connected sequentially so as to form the telescopic structure, each of said bodies having a top plate for covering an upper surface of sheets stored in said bodies, wherein one of said top plates for one sheet supporting body existing in a last stage of the telescopic structure is attached to an upper side of one sheet supporting body existing in a previous stage previous to the last stage, and wherein said top plate for said one sheet supporting body existing in the last stage is stowed on top of said top plate for the sheet supporting body existing in the previous stage.

14. The sheet feeder cassette according to claim 13, further comprising a first sheet supporting body existing in a more previous stage to the previous stage and having a first top plate with a recess formed therein wherein said sheet supporting bodies existing in the last and previous stages are stored in said first sheet supporting body and said top plate for said one sheet supporting body existing in the last stage is accommodated in said recess in said first top plate.

15. A sheet feeder cassette having a telescopic structure, comprising:

a plurality of sheet supporting bodies being connected sequentially so as to form the telescopic structure, each of said bodies having a top plate for covering an upper surface of sheets stored in said bodies, wherein at least one of said top plates for one sheet supporting body existing in a last stage of the telescopic structure is attached to an upper side of one sheet supporting body existing in a previous stage previous to the last stage, and wherein said one top plate for said one sheet supporting body existing in the last stage comprises a plate member pivotally attached to an upper rear end part of said one sheet supporting body existing in the previous stage; and wherein said plate member can be pivoted so as to be placed on a top plate of said one sheet supporting body existing in the previous stage.

16. The sheet feeder cassette according to claim 15, wherein said sheet feeder cassette further comprises an attachment mechanism to attach said sheet feeder cassette to an image forming apparatus, and said top plates support the sheet discharged from the image forming apparatus unitedly.

17. A sheet feeder cassette having a telescopic structure, comprising:

a plurality of sheet supporting bodies being connected sequentially so as to form the telescopic structure, each of said bodies having a top plate for covering an upper surface of sheets stored in said bodies, wherein at least one of said top plates for one sheet supporting body existing in a last stage of the telescopic structure is attached to an upper side of one sheet supporting body existing in a previous stage previous to the last stage, and wherein said one top plate for said one sheet supporting body existing in the last stage comprises a plate member pivotally attached to an upper rear end part of said one sheet supporting body existing in the previous stage; and further comprising a first sheet supporting body existing in a more previous stage to the previous stage and having a first top plate with a recess formed therein wherein said sheet supporting bodies existing in the last and previous stages are stored in said first sheet supporting body and said top plate for said one sheet supporting body existing in the last stage is accommodated in said recess in said first top plate.

18. The sheet feeder cassette according to claim 17, wherein said sheet feeder cassette further comprises an attachment mechanism to attach said sheet feeder cassette to an image forming apparatus, and said top plates support the sheet discharged from the image forming apparatus unitedly.

19. A sheet feeder cassette having a telescopic structure, comprising:

a plurality of sheet supporting bodies being connected sequentially so as to form the telescopic structure, each of said bodies having a top plate for covering an upper surface of sheets stored in said bodies, wherein at least one of said top plates for one sheet supporting body existing in a last stage of the telescopic structure is attached to an upper side of one sheet supporting body existing in a previous stage previous to the last stage, and wherein said one top plate for said one sheet supporting body existing in the last stage comprises a plate member pivotally attached to an upper rear end part of said one sheet supporting body existing in the previous stage; and wherein said sheet feeder cassette further comprises an attachment mechanism to attach said sheet feeder cassette to an image forming apparatus, and said top plates support the sheet discharged from the image forming apparatus unitedly.

20. A sheet feeder cassette having a telescopic structure, comprising:

a plurality of sheet supporting bodies being connected sequentially so as to form the telescopic structure, each of said bodies having a top plate for covering an upper surface of sheets stored in said bodies, wherein at least one of said top plates for one sheet supporting body existing in a last stage of the telescopic structure is attached to an upper side of one sheet supporting body existing in a previous stage previous to the last stage, and wherein said one top plate for said one sheet supporting body existing in the last stage comprises a plate member pivotally attached to an upper rear end part of said one sheet supporting body existing in the previous stage; and wherein said top plate for said one sheet supporting body existing in the last stage is stowed on top of said top plate for the sheet supporting body existing in the previous stage.

21. The sheet feeder cassette according to claim 20, wherein said sheet feeder cassette further comprises an attachment mechanism to attach said sheet feeder cassette to an image forming apparatus, and said top plates support the sheet discharged from the image forming apparatus unitedly.

22. A sheet feeder cassette having a telescopic structure, comprising:

a plurality of sheet supporting bodies being connected sequentially so as to form the telescopic structure, each of said bodies having a top plate for covering an upper surface of sheets stored in said bodies, wherein one of said top plates for one sheet supporting body existing in a last stage of the telescopic structure is attached to an upper side of one sheet supporting body existing in a previous stage previous to the last stage, and wherein said one of said top plates for one sheet supporting body existing in the last stage is detached from the last stage when the last stage is stowed in the previous stage; and further comprising a first sheet supporting body existing in a more previous stage to the previous stage and having a first top plate with a recess formed therein wherein said sheet supporting bodies existing in the last and previous stages are stored in said first sheet supporting body and said top plate for said one sheet supporting body existing in the last stage is accommodated in said recess in said first top plate.

23. A sheet feeder cassette having a telescopic structure, comprising:

a plurality of sheet supporting bodies being connected sequentially so as to form the telescopic structure, each of said bodies having a top plate for covering an upper surface of sheets stored in said bodies, wherein one of said top plates for one sheet supporting body existing in a last stage of the telescopic structure is attached to an upper side of one sheet supporting body existing in a previous stage previous to the last stage, and wherein said one of said top plates for one sheet supporting body existing in the last stage is detached from the last stage when the last stage is stowed in the previous stage; and wherein said top plate for said one sheet supporting body existing in the last stage is stowed on top of said top plate for the sheet supporting body existing in the previous stage.

* * * * *